US008556541B2

(12) United States Patent
Ong

(10) Patent No.: US 8,556,541 B2
(45) Date of Patent: Oct. 15, 2013

(54) PILE DRIVER FOR USE IN A CONFINED SPACE WITH LIMITED HEAD ROOM

(76) Inventor: Chin Chai Ong, Kuala Lumpur (MY)

( * ) Notice: Subject to any disclaimer, the term of this patent is extended or adjusted under 35 U.S.C. 154(b) by 190 days.

(21) Appl. No.: 13/130,115

(22) PCT Filed: Oct. 1, 2009

(86) PCT No.: PCT/MY2009/000163

§ 371 (c)(1),
(2), (4) Date: May 25, 2011

(87) PCT Pub. No.: WO2010/059031

PCT Pub. Date: May 27, 2010

(65) Prior Publication Data

US 2011/0222968 A1 Sep. 15, 2011

(30) Foreign Application Priority Data

Nov. 21, 2008 (MY) ..... PI 20084705

(51) Int. Cl.
*E02D 7/00* (2006.01)

(52) U.S. Cl.
USPC ..... 405/230; 45/229; 45/231; 45/232; 45/244

(58) Field of Classification Search
USPC ..... 405/230, 231, 232, 244; 173/90
See application file for complete search history.

(56) References Cited

U.S. PATENT DOCUMENTS

| | | | | |
|---|---|---|---|---|
| 2,204,283 | A | 6/1940 | Potts et al. | |
| 4,411,408 | A | 10/1983 | Radovan et al. | |
| 4,925,345 | A | 5/1990 | McCown, Jr. et al. | |
| 5,135,335 | A | 8/1992 | Stephens et al. | |
| 5,433,556 | A | 7/1995 | Freeman, III | |
| 5,722,798 | A | 3/1998 | Gregory | |
| 6,368,023 | B1 | 4/2002 | Lau | |
| 6,422,792 | B1 * | 7/2002 | Carlson | 405/230 |
| 7,300,230 | B2 | 11/2007 | Ong | |
| 2006/0275085 | A1 * | 12/2006 | Ong | 405/230 |

FOREIGN PATENT DOCUMENTS

| | | |
|---|---|---|
| EP | 1806455 | 7/2007 |
| EP | 2006070165 | 9/2008 |
| KR | 20-2000-0002770 | 2/2000 |
| KR | 10-2003-0078228 | 10/2003 |
| WO | 9301364 | 1/1993 |

* cited by examiner

*Primary Examiner* — John Kreck
*Assistant Examiner* — Carib Oquendo
(74) *Attorney, Agent, or Firm* — Preston Smirman; Smirman IP Law, PLLC

(57) ABSTRACT

A piling driver (1) to drive a high capacity and maximum continuous length of underpinning pile (61, 62) of at least equal to the clear floor height of a building. The modular piling driver (1) can be assembled on site to drive a pile into the ground within a small confined space under a limited head room comprising of; an underpinning pile (61, 62), a clamping block (2) with horizontal hydraulic clamps (25, 29), a thrust block frame structure (3) with a C-shaped horizontal beam (34) supporting a pair of vertical hydraulic jacks' (4) with corresponding rams (43) that drives the clamping block (2) along the two vertical holding frame members (5) which is supported by a pair of upper and lower locking pins (54) on to the parallel beams (7) that will bear against the soffit of the foundations (8). A method of push pull piling characterized in that apart from only using the counterweight is to utilize the pull resisting force of the adjacent underpinning piles (61*a*, 61*b*, 61*c*) through a system of inter-connecting at least two units of the piling driver (1) into an assembly (9).

18 Claims, 7 Drawing Sheets

图6

PILE DRIVER FOR USE IN A CONFINED SPACE WITH LIMITED HEAD ROOM

CROSS-REFERENCE TO RELATED APPLICATION

The instant application claims priority to PCT International Application No. PCT/MY2009/000163, filed on Oct. 1, 2009, pending, and Malaysian Patent Application No. PI 20084705, filed Nov. 21, 2008, pending, the entire specifications of both of which are expressly incorporated herein by reference.

1. TECHNICAL FIELD OF THE INVENTION

The present invention relates to a modular piling driver to drive a high capacity and maximum continuous length of underpinning pile (62) pile of at least equal to the clear floor height of a building. Further, the pile driver can also insert the pile at or below the foundation sub-structure in confined spaces to save material without having to cut-off extra length. In addition to this advantage, a series of light weight modular basic unit of the present invention can be manually connected together to form an assembly within the excavated foundation to drive piles.

However, it is also noted that the present invention can also be used in the open work spaces.

2. BACKGROUND OF THE INVENTION

Basically, the existing injection pile driver uses a combination of two mechanisms; a vertical driving actuator that is used in conjunction with either a side gripping holder, top gripping holder or just simply pressing down on the pile's top surface.

In the prior arts such as WO93/01364 and U.S. Pat. No. 6,368,023B1, the pile driver employs one or more vertical hydraulic jacks mounted on frames with large dead weights of more than 50 to 1000 tons to be moved on tracks or slide on hydraulic footsteps. This kind of machines is disadvantageous and clearly cannot be moved to work in confined spaces like in a basement of a building.

In U.S. Pat. No. 7,300,230B2 and EP2006070165, as the pile driver that does not use the side gripping mechanism, it will considerably reduce the ability to drive long piles. This driving mechanism will require a tall frame with a rigid horizontal member to support the jack to thrust the ram downwards on to the top of the pile. Using this method is obviously disadvantageous because the pile length will be limited to the clear distance taken from the tip of the hydraulic ram to the top of the existing driven pile in the ground, and moreover only short pile can be driven to avoid buckling.

In U.S. Pat. No. 6,368,023B1, as a modification to increase the driven length of pile without the side gripping mechanism, it uses two drive heads with a frame structure in two driving stages but nevertheless the frame structure will take up some vertical space in a limited room head and is unable to drive a high capacity and maximum continuous length of underpinning pile (62) at least equal to the clear floor height of a building.

In U.S. Pat. No. 5,433,556 and U.S. Pat. No. 2,204,283, a simply pressing down on the pile's top surface requires that the foundation has to be excavated and jacked against the base of the foundation to the top of the pile that is being driven; clearly this is cumbersome, difficult and can only drive many small pile lengths.

U.S. Pat. No. 5,722,798 and U.S. Pat. No. 4,925,345 has disadvantages in the loading method even though using a side gripping mechanism as it requires that the pile be slotted vertically from the top into an opening of a fixed horizontal thrust member which is located some height above the ground, therefore reducing the maximum possible pile length to be driven. Similarly, in U.S. Pat. No. 5,135,335 the twin pile gripping assembly is the obstructing member.

EP2006070165, U.S. Pat. No. 5,722,798 and U.S. Pat. No. 4,925,345 use pile gripping mechanism for driving small pile by means of employing wedges to jam the driving pile is difficult, slow and unable to prevent a total slippage. In another case, U.S. Pat. No. 5,135,335 and U.S. Pat. No. 4,411,408 employ slots in the pile to be used as gripping mechanism, but these slots will be difficult to fabricate in full section such as concrete square pile as it may initiate crack formations.

EP1806455A1 uses top hydraulic clamps in the pull and push method as commonly used in driving sheet piles in a row, however since these pile gripping mechanism is applied from the top of the piles it is therefore unable to drive maximum pile length.

The pile drivers mentioned in the above prior arts have drawbacks such as having either tall frame, heavy and bulky structure or inconvenient top loading of pile which is difficult to mobilise into a small confined space with limited head room and drive the pile at or below the foundation sub-structure. Therefore, the present invention has overcome these disadvantages.

3. SUMMARY OF THE INVENTION

To avoid using many small slender joints of piles, accordingly an object of this present invention is to drive a high capacity and maximum continuous length of underpinning pile (62) in a confined space with limited head room. The object of the present invention teaches that:

The pile driver is light and transportable to work manually in confined spaces and yet able to drive very high capacity piles.

The pile driver has no obstructing horizontal members thus allowing the pile to be displaced horizontally and vertically aligned into the clamping block which is moved to the ground level or even below the foundation sub-structure.

The pile driver can drive the pile below the foundation sub-structure.

The piling driver can drive the underpinning pile (62) truly vertical by levelling the C-shaped horizontal beam using the top and bottom bolts (32) within the threaded section (51) of the respective vertical holding frame members (5).

The pile driver can use the dead weight of the building and have the option to utilise the frictional resistance of the adjacent driven piles in a push and pull method when interconnected into an assembly.

According to the present invention, these objectives above are accomplished by the pile driver comprising of components:

A thrust block frame structure with a C-shaped horizontal member having a side opening with four through openings for the supporting a pair of vertical hydraulic jacks and the two vertical holding frame members;

A pair of upper and lower locking pins attached to the two vertical holding frame members such that will rest on the parallel beams (7) that will bear against the soffit of the foundations to resist the push and pull force from the thrust block frame structure;

A clamping block that slides along the smooth section of the two vertical holding frame members;

A clamping block provided with an orthogonal pair of horizontal hydraulic clamps with interchangeable clamp plates of complimentary contact mouldings to grip the tabular pile;

It should be appreciated that to maximise the potential of the present invention, the modular pile driver can be interconnected into an assembly surrounding the foundation in order to use the push and pull method to utilize the adjacent frictional resistances of the driven piles as reactions to drive the pile with greater force than the building weight.

4. BRIEF DESCRIPTION OF THE DRAWINGS

Further understanding of the aspects of the present invention and their advantages will be discerned after studying the detailed description in conjunction with the accompanying drawings in which:

FIG. 1 shows the dissembled components of the pile driver;

FIG. 2*a* shows the clamping block with top extended wing sections and a typical round pile with complimentary orthogonal pairs of clamps;

FIG. 2*b* shows the clamping block with top and bottom extended wing sections and a typical square pile with complimentary orthogonal pairs of clamps;

5. DETAILED DESCRIPTION OF THE INVENTION

Figure 1:
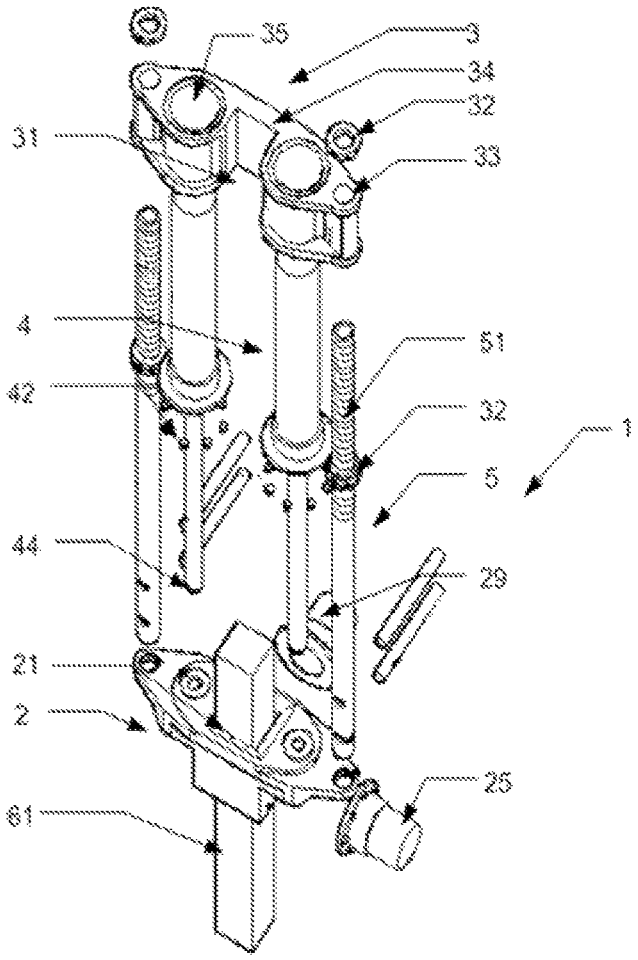

Referring to the drawings, like numerals indicate like components to facilitate explanation. In order to differentiate two separate entities belonging to like components, a suffix "a" or "b" is used to denote the first and second entity.

Components of the Pile Driver

FIG. 1 shows the components of the pile driver (1) according to one embodiment of the present invention. In the broadest aspect of the present invention, the pile driver (1) comprises of an underpinning pile (61), a clamping block (2), a thrust block frame structure (3) and a pair of vertical hydraulic jacks (4).

The underpinning pile (61) can be a tabular and made of any kind of material such as steel, timber or concrete. The thrust block frame structure (3) consists of a C-shaped horizontal beam (34) with a side opening (31) made of steel that is heavily designed to resists twisting and accommodates a pair of vertical hydraulic jacks (4) and two vertical holding frame members (5).

The thrust block frame structure (3) connections is easily detachable by unscrewing the following; bolts (42) at the base of the C-shaped horizontal beam (34) that supports the pair of vertical hydraulic jacks (4), the top and bottom bolts (32) holding two vertical holding frame members (5) upright, and a detachable rotating socket joint (21) that holds the clamping block (2) to the end of the rams (44).

In the plan view, the centreline of the underpinning pile (61) is in line with the centres of the through holes (33, 35) so that there is no overall eccentricity except localised in the C-shaped horizontal beam (34).

Figure 2A:
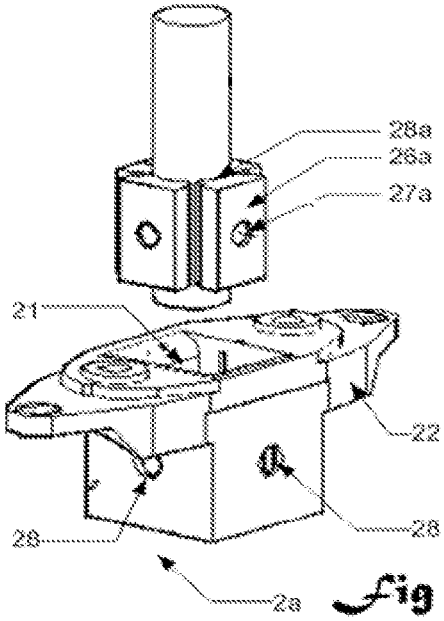

FIG. 2*a* shows the clamping block (2*a*) with a top extended wing sections (22) at both ends. An orthogonal plan of horizontal clamps (25, 29) (not shown here) has corresponding rams that passes through the hole (28) to make contact at the centre (27*a*) of the clamp plates (26*a*). The clamps plates facing (28*a*) are moulded complimentary in shape to the round pile.

Figure 2B:
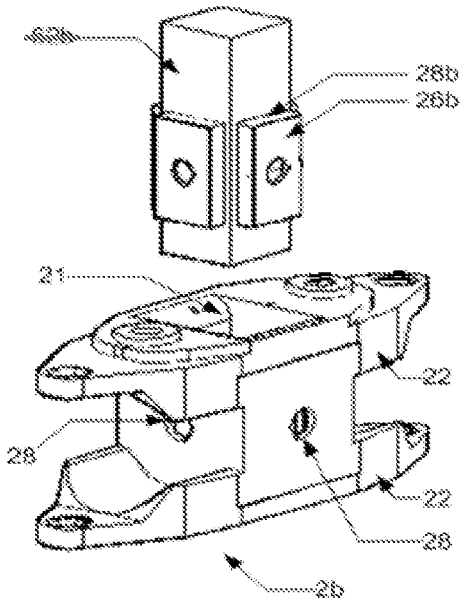

FIG. 2*b* shows the clamping block (2*b*) with a top and bottom extended wing sections (22) at both ends. The clamps plates facing (28*b*) are moulded complimentary in shape to the square pile.

Figure 3:
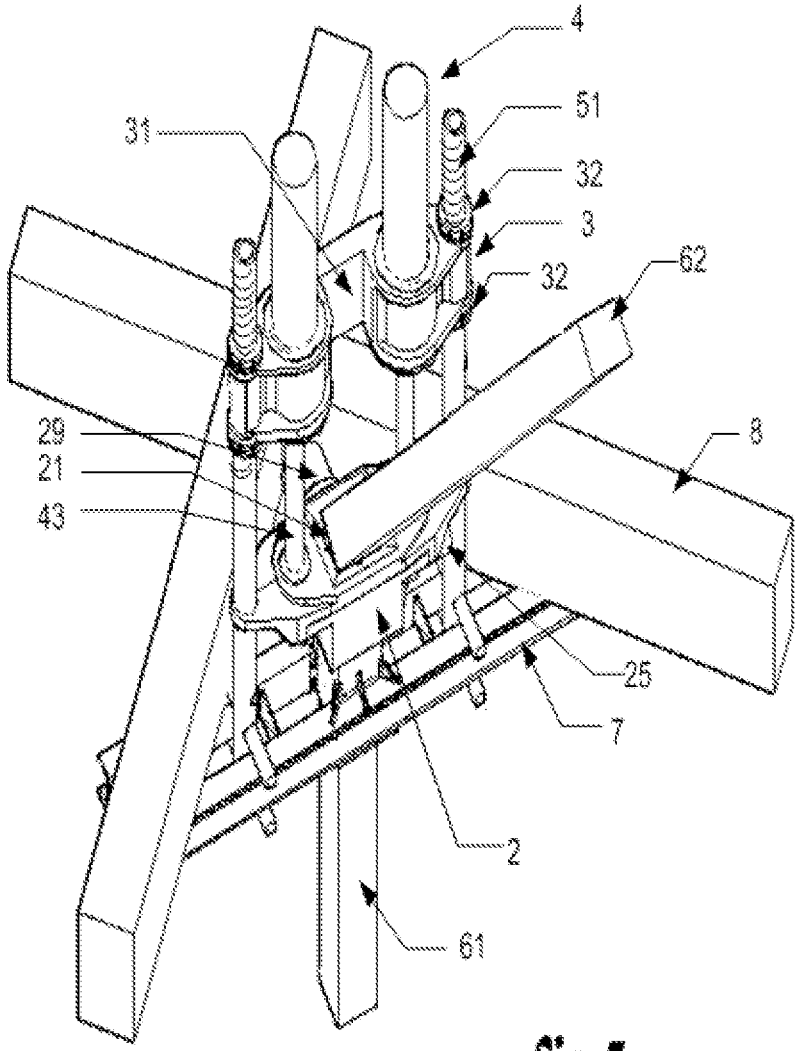
FIG. 3 shows the clamping block being lowered into the clamping block with the horizontal hydraulic clamps opened so that the continuous long pile can be displaced horizontally into pile driver.

FIG. 3 shows the thrust block frame structure (3) has been already levelled vertically by adjusting the bolts (32), the pile driver has driven an underpinning pile (61) below the ground level. The next adjoining underpinning pile (62) is displaced horizontally into the clamping block (2) and aligned vertically into side opening (31) of the C-shaped horizontal beam (34).

Figure 4:
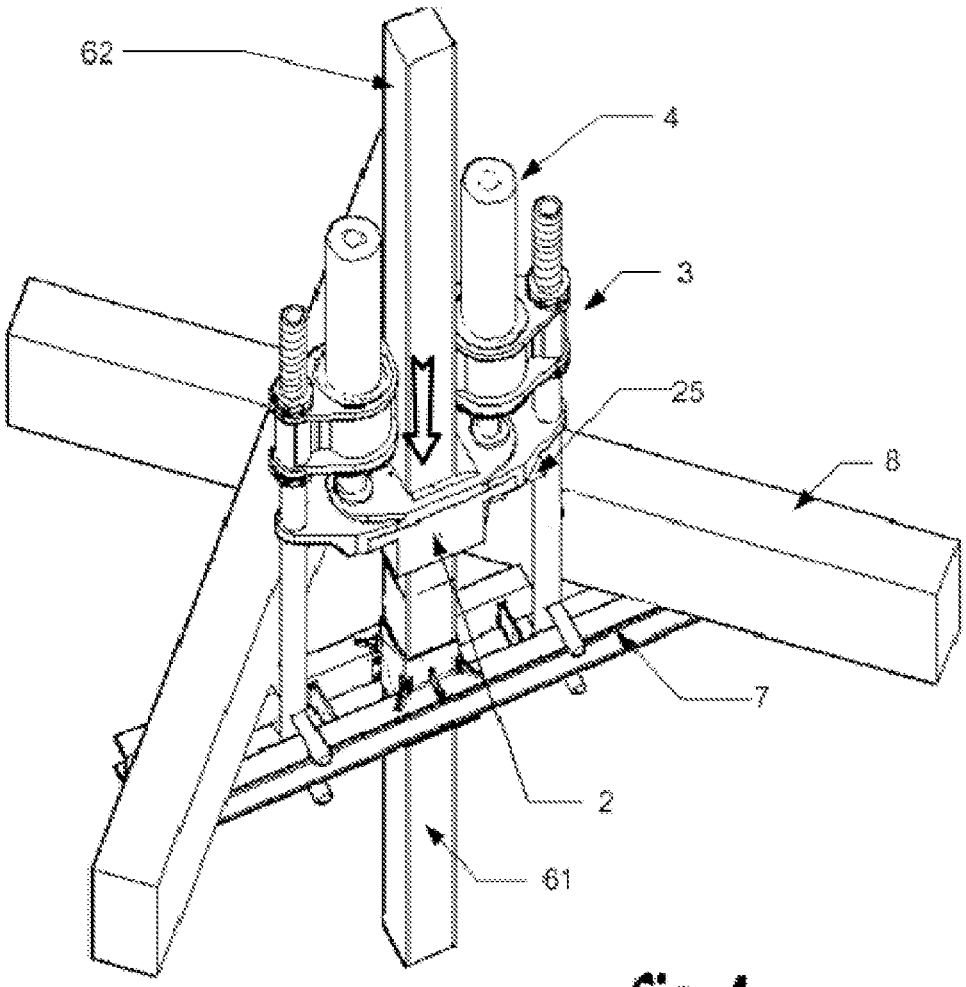
FIG. 4 shows the clamping block moved to the top and the horizontal hydraulic clamps closed ready to drive.

FIG. 4 shows the clamping block (2) is raised to the top position and the horizontal hydraulic clamps are applied to securely grip the underpinning pile (62) ready to be driven down into the ground.

Figure 5:
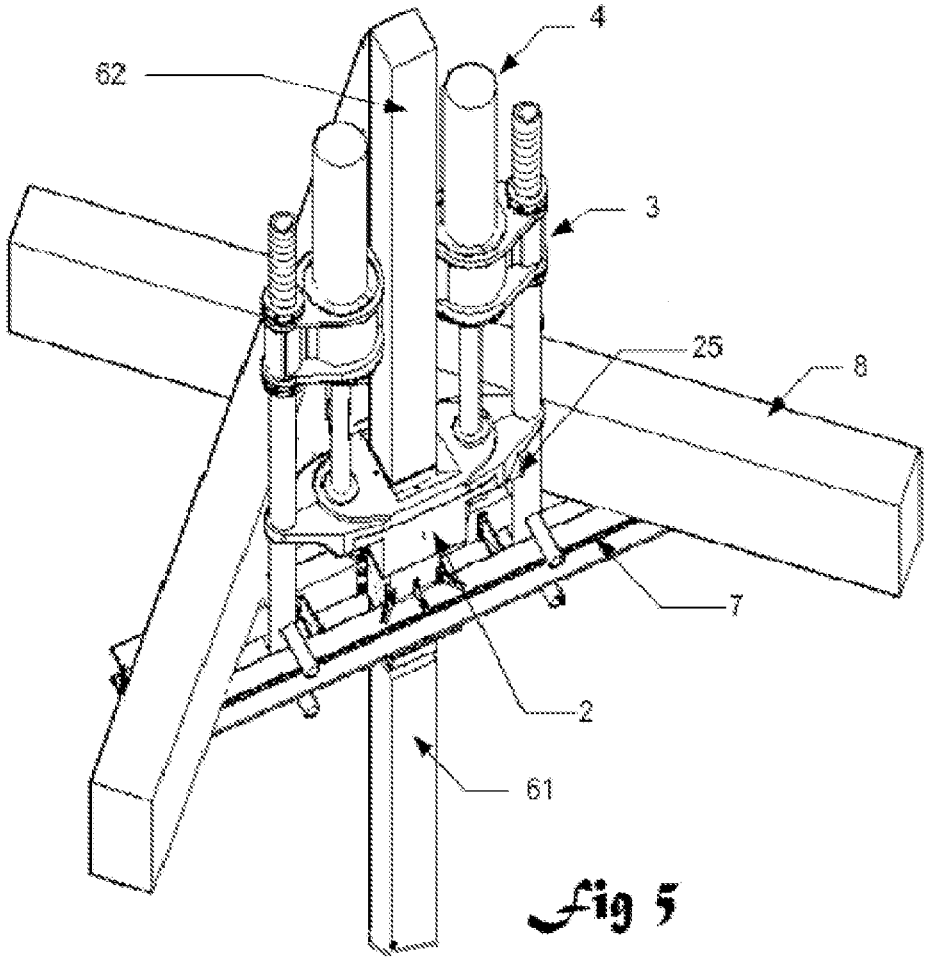
FIG. 5 shows the clamping block is already driven down by extending the rams of the vertical hydraulic jacks and the horizontal hydraulic clamps then released.

FIG. 5 shows the clamping block (2) already driven down into the ground and the horizontal hydraulic clamps are releasing grip on the underpinning pile (62) to allow the clamping block (2) to return to the top most position.

Figure 6:
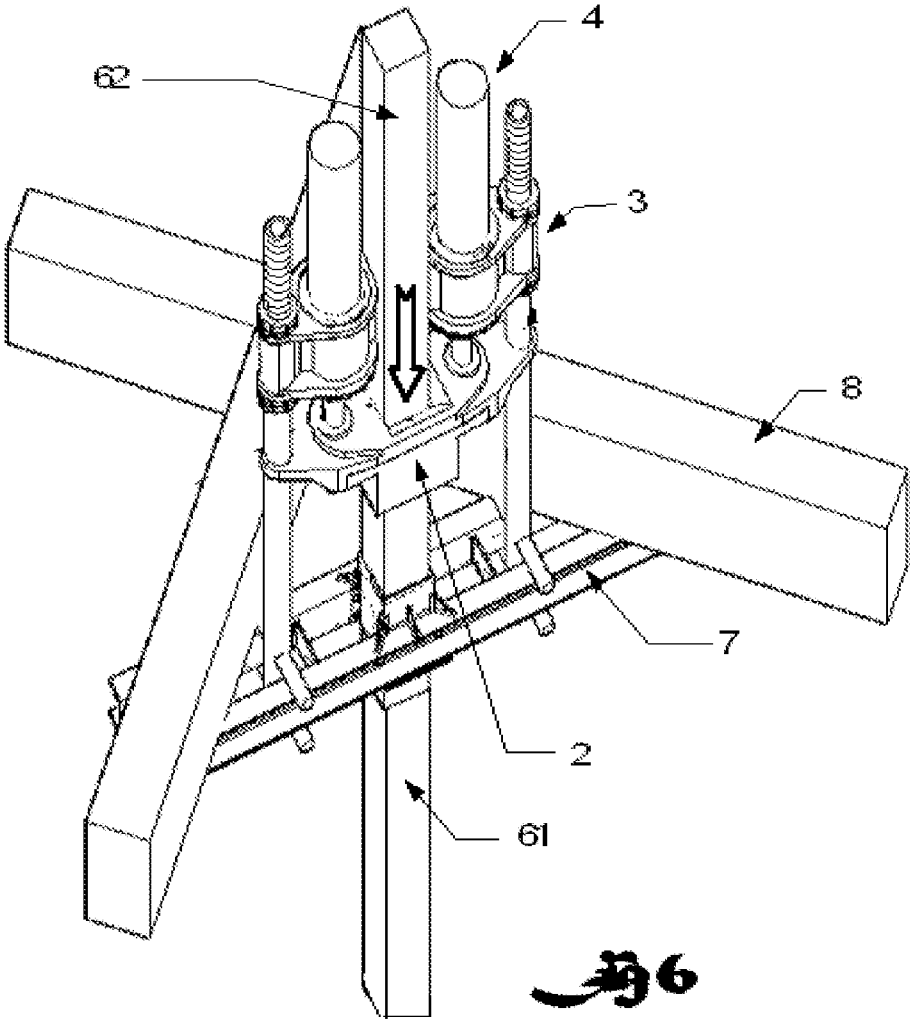
FIG. 6 shows the clamping block is move back upwards by retracting the rams of the vertical hydraulic jacks to repeat the next driving cycle.

FIG. 6 shows the repeat cycle of pile driving beginning again from FIG. 4 to FIG. 6.

Figure 7:
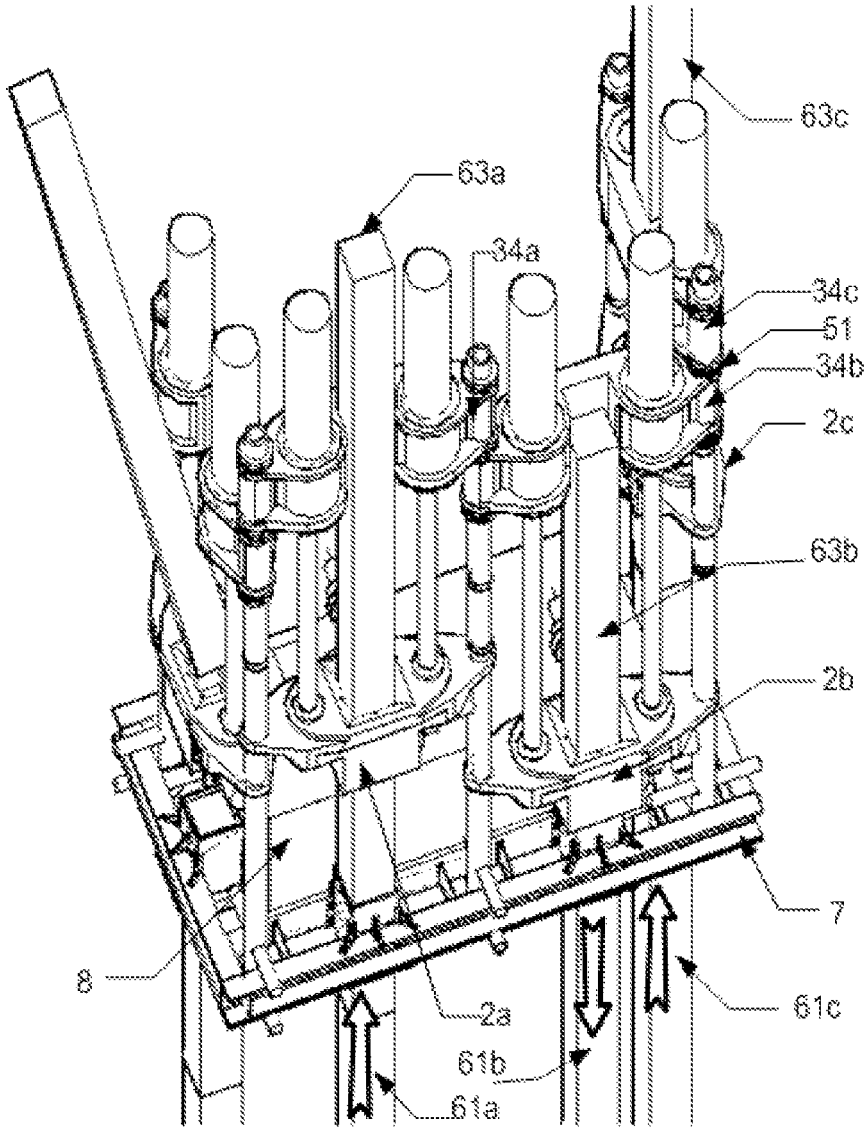
FIG. 7 shows four units of the pile driver assembled around the foundation sub-structure demonstrating the push and pull method to mobilise the pile frictional resistance to aid the driving force.

FIG. 7 shows the four units of the pile driver (1) assembled around the foundation sub-structure (8) demonstrating the push and pull method to mobilise the frictional resistance the adjacent underpinning piles (61*a* or 61*c*) to drive the underpinning pile (63*b*) whilst clamped to the respective clamping blocks (2*a*, 2*b*, 2*c*). The driving of the underpinning pile (63*b*) causes a pull up force acting on the C-shaped horizontal beam (34*b*) which is counteracted by a pull down force acting on the C-shaped horizontal beam (34*a* or 34*b*) generated from pulling the adjacent underpinning piles (61*a* or 61*c*).

The invention claimed is:

1. A piling driver that can be assembled on site to drive an underpinning pile into a ground within a space under a limited head room, comprising:

a pair of vertical holding frame members being supported in between a pair of horizontal parallel beams that have a gap therebetween by a pair of upper and lower locking pins;

a clamping block being inserted through the vertical holding frame members and disposed above the horizontal parallel beams, having a pair of horizontal hydraulic clamps, and a vertical opening for the underpinning pile to be inserted through the vertical opening and the gap in between the horizontal parallel beams; and a thrust block frame structure being inserted through the vertical holding frame members and positioned above the clamping block, having a substantially C-shaped horizontal beam supported by a pair of vertical hydraulic jacks with corresponding rams connected to the clamping block for driving the clamping block along the vertical holding frame members;

wherein the C-shaped horizontal beam has a side opening in the form of a groove that has dimensions that are sufficient for the underpinning pile to be inserted either laterally into the side opening and aligned vertically into the clamping block, or vertically into the side opening and the clamping block, such that the piling driver can drive a high capacity and maximum continuous length of the underpinning pile or at least equal to a clear floor height of a building, and the clamping block can slide smoothly along the two vertical holding frame members to at or below the foundation sub-structure whilst securely clamping the underpinning pile when being push down or pulled up by the rams against the thrust block frame structure.

2. The piling driver according to claim 1, wherein the side opening of the C-shaped horizontal beam has been designed to be formed substantially at the center of the C-shaped horizontal beam such that the C-shaped horizontal beam is substantially non-symmetrical in one axis but is heavily designed to resist twisting.

3. The piling driver according to claim 1, wherein the C-shaped horizontal beam has at least four vertical through holes including two inner through holes to accommodate the vertical hydraulic jacks and two outer through holes at the extreme ends to accommodate the two vertical holding frame members such that a distance between the clamping block and the thrust block frame structure are adjustable.

4. The piling driver according to claim 1, wherein the C-shaped horizontal beam, wherein a plan view centerline of the underpinning pile, is in line with the centres of at least four vertical through holes so that there is no overall eccentricity.

5. The piling driver according to claim 1, wherein the C-shaped horizontal beam is rigidly fixed at a base with the pair of vertical hydraulic jacks using bolts.

6. The piling driver according to claim 1, wherein the two vertical holding frame members has a threaded section for allowing the pile driver to drive the underpinning pile vertically by levelling the C-shaped horizontal beam, and a lower smooth section.

7. The piling driver according to claim 1, wherein the C-shaped horizontal beam can be levelled by adjusting top and bottom bolts within a threaded section of the respective vertical holding frame members so that the underpinning pile can be driven truly vertical.

8. The piling driver according to claim 1, wherein each of the vertical holding frame members has at least two through holes to accommodate top and bottom lock pins.

9. The piling driver according to claim 1, wherein each of the vertical holding frame members allows a driving or pulling force on the underpinning pile to be resisted by the top and bottom lock pins on to the parallel beams.

10. The piling driver according to claim 1, wherein the vertical hydraulic jacks are connected at a downwards end of the rams to the clamping block by means of a detachable rotating socket joint.

11. The piling driver according to claim 1, wherein the clamping block at both horizontal extreme ends has top extended wing sections that is provided with a through hole to accommodate a smooth bearing to slide along a lower smooth section of the two vertical holding frame members.

12. The piling driver according to claim 1, wherein the clamping block has top extended wing sections or bottom extended wing sections or both top and bottom extended wing sections.

13. The piling driver according to claim 1, wherein the clamping block has an orthogonal pair or at least a pair of interchangeable clamp plates with moulded facings of complimentary shapes to accommodate a round pile or a square pile respectively or any other tubular shapes.

14. The piling driver according to claim 1, wherein the clamping block has a mechanism for gripping the underpinning pile at the sides of the clamping block that uses an orthogonal pair of horizontal hydraulic clamps or at least one set of horizontal hydraulic clamps.

15. A method of piling comprising the steps of:

driving at least a underpinning pile using a system that includes at least two interconnected pile drivers that are each formed from a pair of vertical holding frame members being supported in between a pair of horizontal parallel beams that has a gap therebetween by a pair of upper and lower locking pins; and providing a clamping block inserted through the vertical holding frame members and disposed above the horizontal parallel beams, having a pair of horizontal hydraulic clamps, and a vertical opening for the underpinning pile to be inserted through the vertical opening and the gap in between the horizontal parallel beams; and a thrust block frame structure being inserted through the vertical holding frame members and positioned above the clamping block, having a C-shaped horizontal beam supported by a pair of vertical hydraulic jacks with corresponding rams connected to the clamping block for driving the clamping block along the vertical holding frame members;

wherein the corresponding rams extend and retract vertically to drive the clamping block along the vertical holding frame members through repeated cycles of gripping, pushing downwards to the bottommost position, release of gripping, and moving upwards again of the clamping block to an original topmost position, and that the underpinning pile is driven by exerting a pull resisting force to at least an adjacent underpinning pile in an adjacent pile driver the system, and/or using a counterweight of a building.

16. The method according to claim 15, wherein the system can be manually assembled in situ using a modular piling driver by sharing of one side of a thrust block frame structure.

17. The method according to claim 16, wherein the one side of the thrust block frame structure is shared through securing at the top and bottom of respective adjacent horizontal members on to a common vertical sliding members by means of bolts.

18. The method according to claim 15, wherein the C-shaped horizontal beam is subject to a pull force when a frictional resistance is transmitted through pulling the adjacent underpinning piles to drive the underpinning pile that is clamped to respective clamping blocks due to the underpinning pile being counteracted by a pull down force acting on the C-shaped horizontal beam generated from pulling the adjacent underpinning piles when the underpinning pile is being driven.

* * * * *